US005095817A

United States Patent [19]

Takamura

[11] Patent Number: 5,095,817

[45] Date of Patent: Mar. 17, 1992

[54] THIN FILM SUPPLYING MECHANISM

[75] Inventor: Tohru Takamura, Tokyo, Japan

[73] Assignee: Kabushiki Kaisha Shinkawa, Tokyo, Japan

[21] Appl. No.: 621,282

[22] Filed: Nov. 30, 1990

[51] Int. Cl.[5] ..... B41F 9/00; B41F 1/38

[52] U.S. Cl. ..... 101/163; 101/287

[58] Field of Search ..... 101/150, 163, 164, 165, 101/166, 170, 35, 41, 44, 287, 316, 317, 318-320, 155, 157, 167, 169

[56] References Cited

U.S. PATENT DOCUMENTS 4,557,195 12/1985 Philipp ..... 101/163

*Primary Examiner*—J. Reed Fisher

*Attorney, Agent, or Firm*—Koda and Androlia

[57] ABSTRACT

A thin film supplier for supplying ink, paste etc., used in relief-plate printing devices, die bonders etc., including an original printing plate placed on a table. The printing plate is provided with a through hole, and a bridge piece is placed in this hole. A recess is formed in the through hole by the bridge piece which has a thickness less than that of the printing plate, and ink, paste, etc. is poured into the recess so that a relief printing plate attached to a plate holder is immersed in such ink, paste, etc.

4 Claims, 2 Drawing Sheets

FIG. 1(a)
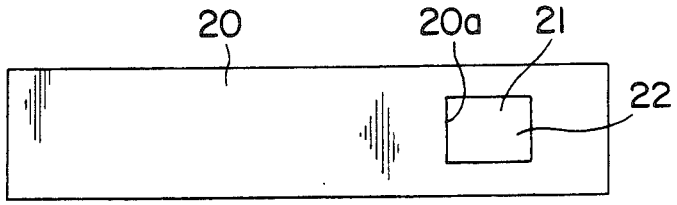
FIG. 1(b)
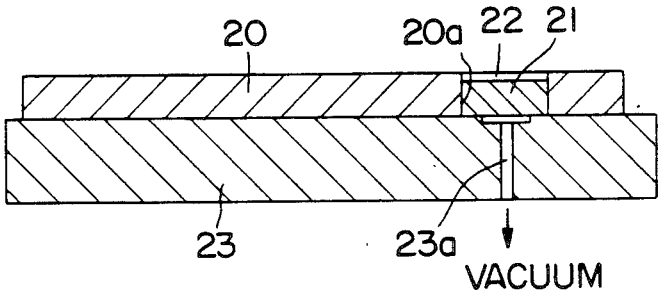
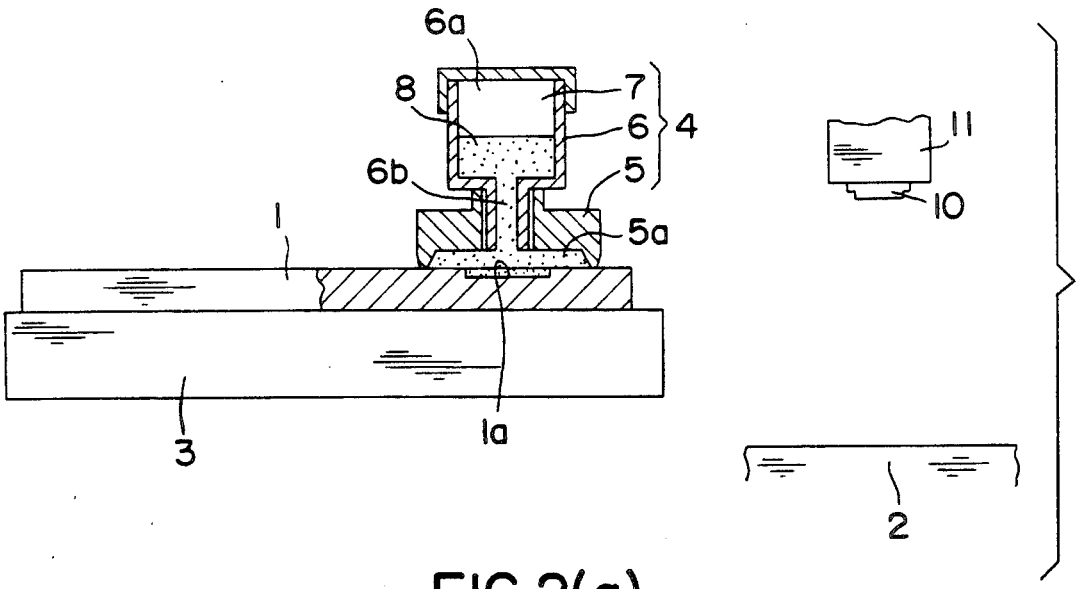
FIG. 2(a)
PRIOR ART

FIG. 2(b)
PRIOR ART
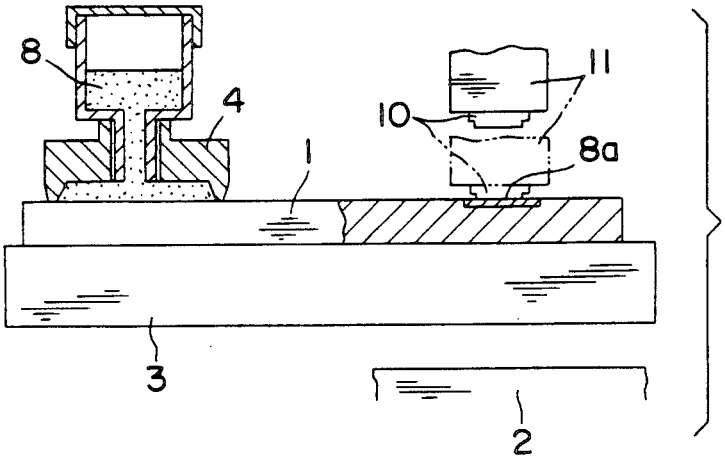
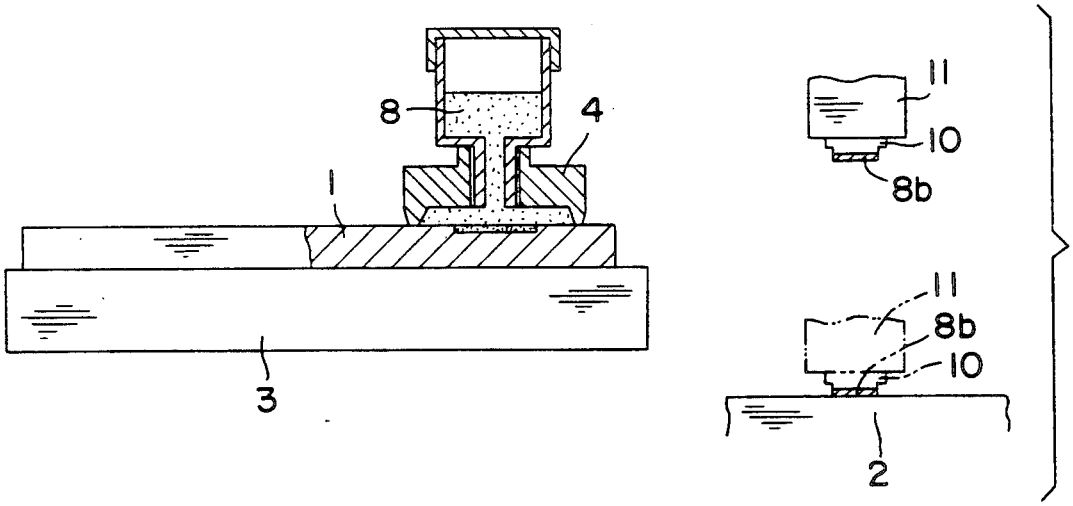
FIG. 2(c)

THIN FILM SUPPLYING MECHANISM

BACKGROUND OF THE INVENTION

1. Field of the Invention

The present invention relates to a thin film supplying mechanism used in a paste supplier etc., employed in relief-plate printing devices and die bonders.

2. Prior Art

One of conventional relief-plate printing devices is constructed as shown in FIG. 2. Specifically, a recess 1*a* is formed in the upper surface of a original printing plate 1 which is made of glass or metal. The recess la has the depth of approximately 4 to 12 microns that corresponds to the thickness of ink film coated on an item 2 upon which printing is performed. This original printing plate 1 is positionally fixed on a table 3 which is moved horizontally by a driving means (not shown).

An ink pot 4 is installed above the original printing plate 1 so that the ink pot 4 can move up and down. This ink pot 4 consists of a blade 5, an ink tank 6 which is screw-connected with the blade 5 (so that the ink tank 6 can be freely removed from the blade 5), and a lid 7 which covers the top of the ink tank 6. An ink reservoir 5*a* is formed in the lower portion of the blade 5. An ink accommodating part 6*a* is formed in the upper portion of the ink tank 6, and a slit 6*b* which leads from the ink accommodating part 6*a* to the ink reservoir 5*a* is also formed in the ink tank 6.

A plate holder 11 which has a rubber relief printing plate 10 on its lower surface is installed above the right hand portion of the original printing plate 1. The plate holder 11 can be freely moved up and down. The item 2 to be printed is positioned beneath the plate holder 11.

Operation of the device will be described below:

The table 3 moves horizontally to the right (as shown in FIG. 2 (*b*)) with the ink pot 4 lowered and the lower end of the ink pot 4 pressed against the original printing plate 1 (as shown in FIG. 2(*a*)). With this movement, the ink 8 inside the ink reservoir 5*a* fills the recess 1*a* of the original printing plate 1.

Next, the plate holder 11 is lowered as indicated by the two-dot chain line. As a result, the rubber relief printing plate 10 comes into contact with the ink 8*a* of the recess 1*a*. Thus, the ink 8*a* adheres to the rubber relief printing plate 10.

The plate holder 11 then rises and the table 3 moves horizontally left as shown in FIG. 2(*c*). Afterward, the plate holder 11 is again lowered as indicated by the two-dot chain line. As a result, the rubber relief printing plate 10 is pressed against the item 2. Thus, the ink 8*b* adhering to the undersurface of the rubber relief printing plate 10 is transferred to the item 2. Then, the plate holder 11 is raised to its original position.

In the prior art described above, the recess 1*a* is formed in the original printing plate 1 by etching. Accordingly, when the thickness of the ink film applied to the item 2 is changed, the entire original printing plate 1 must be replaced. Accordingly, every time the original printing plate 1 is replaced, the lower-limit position and inclination of the ink pot 4 must be adjusted in accordance with the surface conditions (inclination) and thickness variations of the original printing plate 1. Otherwise, the lower surface of the ink pot 4 does not meet correctly with the upper surface of the original printing plate 1. Thus, a considerable amount of time is required for such adjustments.

SUMMARY OF THE INVENTION

Accordingly, the object of the present invention is to provide a thin film supplying mechanism which performs adjustment work in a short period of time when the film thickness is changed.

The problems found in the prior art system is solved by a unique structure of a thin film supplying mechanism which includes (a) a pot that accommodates a coating liquid, (b) a original printing plate which has a recess formed in its upper surface, (c) a table which holds this original printing plate, and (d) a horizontal driving means which causes the original printing plate and pot to move horizontally relative to each other with the lower end of the pot pressed against the upper surface of the original printing plate, wherein (i) a portion of the original printing plate which corresponds to the recess is formed as a through hole, and (ii) a bridge piece is placed in this hole, so that a recess is created by the thickness difference between the original printing plate and the bridge piece.

When the thickness of the film to be applied is changed, it is only necessary to change the bridge piece in accordance with desired film thickness (leaving the original printing plate "as is"). Accordingly, is no need to adjust the ink pot. As a result, the adjustment can be performed very easily and in a short period of time. If the sliding surface of the original printing plate upon which the ink pot slides becomes worn after long-term use, the original printing plate can be reused by merely regrinding the original printing plate and changing the thickness of the bridge piece.

BRIEF DESCRIPTION OF THE DRAWINGS

FIG. 1 illustrates the essential section of one embodiment of the present invention, in which:

FIG. 1(*a*) is a plan view of the thin film supplying mechanism; and

FIG. 1(*b*) is a cross section thereof;

FIG. 2 illustrates a conventional example in which:

FIG. 2(*a*) is a diagram illustrating the operation in which the ink pot is pressed against original printing plate; and FIG. 2(*b*) is a diagram illustrating the operation in which the ink is applied to a rubber relief printing plate of a plate holder; and FIG. 2(*c*) is a diagram illustrating the operation in which the ink on the rubber relief printing plate is transferred to the an item to be printed.

DETAILED DESCRIPTION OF THE INVENTION

One embodiment of the present invention will be described below with reference to FIG. 1.

A original printing plate 20 is provided with a through hole 20*a* which is used as a recess. The hole 20*a* is formed so that the hole opens entirely through the thickness of the plate 20. A bridge piece 21 is inserted in this hole 20*a* so that a recess 22 is formed. The depth of the recess 22 is determined by the difference between the thickness of the original printing plate 20 and the thickness of the bridge piece 21.

Accordingly, by preparing a multiple number of bridge pieces 21 with different thicknesses, it is possible to change the depth of the recess 22 merely by changing the bridge pieces 21 of different thickness.

A suction hole 23*a* is formed in the table 23. Through this hole 23*a*, suction is applied to the bridge piece 21 via a vacuum pump (not shown). Thus, the bridge piece 21 is securely held in a prescribed position in the hole 20*a*.

Accordingly, if vacuum suction is applied to the bridge piece 21, the undersurface of the bridge piece 21 is pulled held tightly to the (bottom of the) recess 22. Thus, the bridge piece 21 is stably held at a prescribed position in the hole 20*a*. The depth of the recess 22 is, accordingly, kept stable.

In the embodiment described above, the invention is applied to a relief-plate printing device. However, it is possible to apply the present invention to a paste supplying device of a die bonder. In this case, it goes without saying that the coating liquid used would be a paste instead of ink.

In the present invention, as is clear frame the above description, it is merely necessary to change the bridge piece in accordance with the desired film thickness. The depth of the recess can be very easily adjusted in a short period of time. Even though the sliding surface of the original printing plate has become worn after long-term use, the original printing plate can be reused by regrinding the original printing plate and by changing the thickness of the bridge piece used.

I claim:

1. A thin film supplying mechanism comprising a pot which accommodates a coating liquid, a original printing plate provided with a recess formed in its upper surface, a table which holds said original printing plate, and a horizontally driving means which causes said original printing plate and pot to move horizontally relative to each other with lower end of said pot being pressed against upper surface of said original printing plate, said system being characterized in that a portion of said original printing plate which corresponds to said recess is formed as a hole which passes entirely through said original printing plate, and a bridge piece is placed in said hole so that a recess is formed by thickness difference between said original printing plate and bridge piece.

2. A thin film supplying mechanism according to claim 1, wherein said bridge piece is fixed to said table by suction adhesion via a vacuum means.

3. A thin film supplying mechanism comprising a pot containing a coating liquid, an original printing plate provided on a table which holds said original printing plate, and a driving means which horizontally moves said original printing plate and pot relative to each other with lower end of said pot being pressed against upper surface of said original printing plate, said system being characterized in that a through hole is provided in said original printing plate and a bridge piece having a thickness less than that of said printing plate is placed in said through hole so that a recess for said coating liquid is formed by a thickness difference between said original printing plate and bridge piece.

4. A thin film supplying mechanism according to claim 3 further comprising a suction hole provided in said table, one end of said suction hole opening to said through hole of said original printing plate so that said bridge piece is sucked held in said through hole by suction adhesion.

* * * * *